United States Patent [19]

Suefuji et al.

[11] Patent Number: 4,475,360

[45] Date of Patent: Oct. 9, 1984

[54] REFRIGERATION SYSTEM INCORPORATING SCROLL TYPE COMPRESSOR

[75] Inventors: Kazutaka Suefuji; Kensaku Oguni; Sumihisa Kotani; Kenji Tojo, all of Shimizu, Japan

[73] Assignee: Hitachi, Ltd., Tokyo, Japan

[21] Appl. No.: 458,923

[22] Filed: Jan. 18, 1983

[30] Foreign Application Priority Data

Feb. 26, 1982 [JP] Japan ..... 57-29010

[51] Int. Cl.[3] ..... F25B 13/00

[52] U.S. Cl. ..... 62/324.1; 62/503

[58] Field of Search ..... 62/324.1, 498, 503, 62/508; 418/55

[56] References Cited

U.S. PATENT DOCUMENTS

| | | | |
|---|---|---|---|
| 3,884,599 | 5/1975 | Young et al. | 418/55 |
| 4,030,315 | 6/1977 | Harnish | 62/503 X |
| 4,187,695 | 2/1980 | Schumacher | 62/503 |
| 4,215,555 | 8/1980 | Cann et al. | 62/503 X |
| 4,382,370 | 5/1983 | Suefuji et al. | 62/324.1 |

*Primary Examiner*—Lloyd L. King

*Attorney, Agent, or Firm*—Antonelli, Terry & Wands

[57] ABSTRACT

A refrigeration system including a scroll type compressor having a stationary scroll member, an orbiting scroll member, a discharge port formed in the central portion of the end plate of the fixed scroll member, a suction port formed in a peripheral portion of the fixed scroll member, and at least one gas injection port formed through the thickness of an end plate of the fixed scroll member in a portion of the end plate near the spiral wrap, at a position spaced from the wall of the spiral wrap by a radial distance less than the thickness of the spiral wrap. A discharge pipe is connected to the discharge port, with a suction pipe being connected to the suction port. A refrigerant circuit is connected between the suction pipe and the discharge pipe of the scroll type compressor and includes a four-way valve, indoor heat exchanger, first pressure reducer, gas-liquid separator, second pressure reducer and an outdoor heat exchanger. A gas injection passage is connected between the gas outlet formed in an upper part of the gas-liquid separator and the gas injection port, so as to permit the refrigerant gas in the upper part of the gas-liquid separator to be additionally supplied into the compression chambers under compression in the scroll type compressor.

13 Claims, 7 Drawing Figures

REFRIGERATION SYSTEM INCORPORATING SCROLL TYPE COMPRESSOR

BACKGROUND OF THE INVENTION

The present invention relates a refrigeration system incorporating a scroll type compressor equipped with a gas injection mechanism.

Generally, a scroll type compressor is constituted by an orbiting scroll member having an end plate and a wrap formed along an involute curve or a curve approximately an involute curve so as to protrude upright from one side of the end plate, and a fixed scroll member having an end plate provided with a central discharge port and a peripheral suction port and a wrap similar to that of the orbiting scroll member and protruding upright from the end plate. The orbiting scroll member and the fixed scroll member are assembled together such that their wraps mate with each other, and are housed by a common housing which is provided with a suction pipe and a discharge pipe.

An Oldham's ring is disposed between the orbiting scroll member and the frame of the compressor or between the orbiting scroll member and the fixed scroll member, so as to prevent the orbiting scroll member from rotating around its own axis. A crank shaft engaging with the orbiting scroll member causes an orbiting motion of the orbiting scroll member without permitting the latter to rotate around its own axis so that a gas confined in the closed chmabers defined by the scroll members is progressively compressed and discharged from the discharge port. An example of this scroll-type compressor is disclosed in, for example, U.S. Pat. No. 3,884,599.

The flow rate of the gas compressed by this compressor is determined by the specific volume of the gas sucked into the suction chamber formed between two scroll members and by the maximum confinement volume which is created when the suction chamber is changed into a compression chamber as a result of the orbiting motion of the orbiting scroll member. Since this maximum confinement volume is fixed, the flow rate is maintained constant provided that the specific volume of the gas is unchanged.

As to the air conditioning throughout a year, the heating load demanded in winter season is greater than the cooling load in the summer season. In this connection, it is to be noted that the ratio between the cooling capacity and heating capacity is almost one, i.e. the cooling capacity and the heating capacity are almost equal, in ordinary heat-pump type air conditioner incorporating a refrigeration system. This means that the shortage of heating capacity in winter season is inevitable. To make up for the shortage of the heating capacity, it is a common measure to provide an additional heat source such as an electric heater to assist the air conditioner in effecting the heating in the winter season. However, since the increase in the heating capacity is equal to the increase in the input power, the energy efficiency ratio is much smaller than that attained when no electric heater is used.

A system called "gas injection system" is known for increasing the capacity of the air conditioner without using any additional heat source such as electric heater. The gas injection system incorporates a rotary compressor, a screw compressor and so forth, and has the following features.

A first expansion valve is disposed at the downstream side of the condenser of a refrigeration system, and a gas-liquid separator is connected to the downstream side of the first expansion valve. The gas-liquid separator has a gas outlet and a liquid outlet. A second expansion valve is connected to the downstream side of the liquid outlet of the gas-liquid separator, and the outlet side of the second expansion valve is connected to an evaporator. On the other hand, the gas outlet is connected to a gas injection port which opens to a compression chamber on its way of compression. Consequently, the pressure in the gas-liquid separator is maintained at an intermediate level between the suction pressure and the discharge pressure.

In this type of gas injection system, there are provided two refrigerant circuits: namely, a circuit constituted by a loop starting from the compressor and ending in the same through the condenser, first pressure reducer, gas-liquid separator, second pressure reducer, and the evaporator; and a circuit constituted by a loop which is common to the first circuit from the compressor down to the gas-liquid separator but shunts from the first circuit at the separator and leads to the compressor.

In the gas injection system, the rate of heat extracted is increased in the evaporator because of a large difference in enthalpy of the refrigerant between the inlet and outlet of the evaporator, while, in the condenser, the heat discharge is increased because of an increase in the flow rate of the refrigerant. Thus, the gas injection system conveniently increases both of the heating capacity and cooling capacity.

According to the gas injection system, the increase of the compression work due to an increase of the flow rate of refrigerant takes place only in a part of the whole compression work, i.e. from a point intermediate of the compression to the end of the discharge. This increase is much smaller than the increase of the compression work which would be incurred in a single-stage compressor when the injection of the additional refrigerant is made from the beginning of the compression. This means that the gas injection system advantageously offers an increase in the energy efficiency ratio. Unlike the case of the electric heater, the increase in the capacity offered by the gas injection is achieveable not only in the heating mode but also in the cooling mode of the operation. It is, therefore, possible to make the gas injection, for a while after a starting of the cooling operation, accelerate the cooling in the period immediately after the start up of the air conditioner.

When the gas injection system is applied to a compressor which completes one cycle by one rotation, e.g. a rotary compressor or a screw compressor, the rate of increase of the pressure in the compression chamber is so large that the gas injection is allowed only for a limited period. Therefore, in order to effect the gas injection at a large rate it is necessary to preserve a large area of the injection port. However, the increase area of the injection port is accompanied by an increase in the gap volume of the compression chamber which, in turn, increases the internal leak of the gas disadvantageously resulting in an increased loss of power.

Furthermore, in the rotary compressor, the injection port opens substantially over the entire area of the compression stroke so that it is necessary to employ a suitable means for preventing the reversing of the refrigerant from the compression chamber or for limiting the period of the injection in such a manner as to prevent the injection in the period in which the internal pressure of the compression chamber exceeds the injection pressure.

There have been no proposals as to the adoption of the gas injection system in a refrigeration system having a scroll type compressor, although in Japanese Utility Model Laid-Open No. 85807/1981 proposes a liquid injection system resembling a gas injection system to a refrigeration system having a scroll type compressor. However, this liquid injection system is intended for cooling the compressor by introducing liquid refrigerant into the compression chamber under compression, to thereby suppress a temperature rise in the winding of motor or lubricating oil to prevent degradation and burning of the bearing.

While the discharge rate is increased as a result of the proposed liquid injection, the total heating capacity is unaltered because the enthalpy of the refrigerant is lowered at the condenser inlet. The evaporator side is materially identical to that in the ordinary refrigerant circuit and the refrigeration power is materially equivalent to that of the ordinary refrigeration system. Moreover, the liquid injection system imposes a problem that the energy efficiency ratio is reduced due to an increase of input to the compressor.

Japanese Patent Laid-Open No. 81513/1979 discloses a scroll type compressor in which a part of the gas discharged from the discharge port of the compressor and is cooled and then sent to a pressure reducer which reduces the pressure of the cooled gas to an intermediate pressure. The gas of the intermediate pressure is then introduced into the housing of the compressor to impart an axial pressing force to the orbiting scroll member. In addition, an injection port communicating with the housing is formed in the fixed scroll member or the orbiting scroll member and the gas is injected through this injection port into the closed space defined between the wraps of the orbiting scroll member and fixed scroll member to thereby cool the bearing and the back side of the orbiting scroll member, as well as the driving motor. However, the injection of the gas in this compressor is not intended to increase the heating or cooling capacity.

SUMMARY OF THE INVENTION

Accordingly, an object of the invention is to provide a heat pump type air conditioner having a refrigeration system incorporating a scroll type compressor, in which a gas injection system is adopted to increase the heating or cooling capacity.

Another object of the invention is to provide an air conditioner which can operate with different optimum capacities in cooling mode and heating mode, by allowing a gas injection only in the heating mode operation to increase the heating capacity.

Still another object of the invention is to provide an air conditioner in which large increase in the cooling and heating capacities is attained with small increase in the input to thereby to achieve a higher energy efficiency ratio.

To this end, according to the invention, there is provided a refrigeration system incorporating a scroll type compressor in which a gas injection port is formed in the portion of the end plate of the fixed scroll member defining a compression chamber under compression at a position near the wall of the spiral wrap. More specifically, the gas injection port is formed at a position which is spaced from the wall of the spiral wrap by a distance which is smaller than the thickness of the spiral wrap. The scroll type compressor is connected to a four-way valve, indoor heat exchanger, first expansion valve, gas-liquid separator, second expansion valve and an outdoor heat exchanger so as to form a refrigerant circuit. A gas injection passage connects the gas outlet of the gas-liquid separator of the refrigerant circuit to the gas injection port, to thereby permit the injection of the refrigerant gas accumulated at the upper portion of the gas-liquid separator into the compression chamber under compression.

By virtue of the features of the invention it is possible to adopt a gas injection system to a refrigeration system having a scroll type compressor. By so doing, the flow rate of the refrigerant through the condenser is increased in both of the cooling and heating modes, so that the delivery of heat is increased to enhance the heating and cooling capacities.

The scroll type compressor completes one cycle of compressoin in several rotations, so that the rate of increase of pressure is comparatively small. This means that the pressure in the compression chamber is maintained below the injection pressure for longer time than in other type of compressors. In addition, the injection port can be held in communication with the compression chamber for a period of about one rotation. For these reasons, it is possible to attain an effective injection even though an injection port has a small area. The small area of the injection port in turn reduces the gap volume around the port so that internal leakage of the gas is also reduced. As a result, wasteful compression is eliminated to ensure a remarkable increase in energy efficiency.

In addition, since the gas-liquid separator is disposed between the first and second expansion valves, the pressure in the gas-liquid separator is higher than the suction pressure. Therefore, the refrigerant gas accumulated in the upper port of the gas-liquid separator is injected into the compression chamber which has just cleared the suction port and, hence, has a sufficiently low internal pressure. As a result of the orbiting movement of the orbiting scroll member, the pressure in the compression chamber is increased gradually and, when the pressure is increased to exceed the injection pressure, the gas injection port is disconnected from the compression chamber so that the injection of gas to this compression chamber is stopped. The injection port then communicates with the next compression chamber. Since the compression chamber communicates with the gas injection port only when the pressure in the compression chamber is low, it is not necessary to employ specific mechanism for preventing reversing of refrigerant in the injection passage.

It is possible to increase the heating capacity as compared with the cooling capacity and, hence, to improve the heating to cooling ratio, by arranging that the injection passage is opened during heating to permit the injection of the refrigerant gas from the gas-liquid separator whereas, during the cooling, the injection passage is closed to cut-off the injection.

BRIEF DESCRIPTION OF THE DRAWINGS

The invention will be more fully understood from the following description of the preferred embodiments taken in conjunction with the accompanying drawings in which.

DESCRIPTION OF THE PREFERRED EMBODIMENTS

Figure 1:
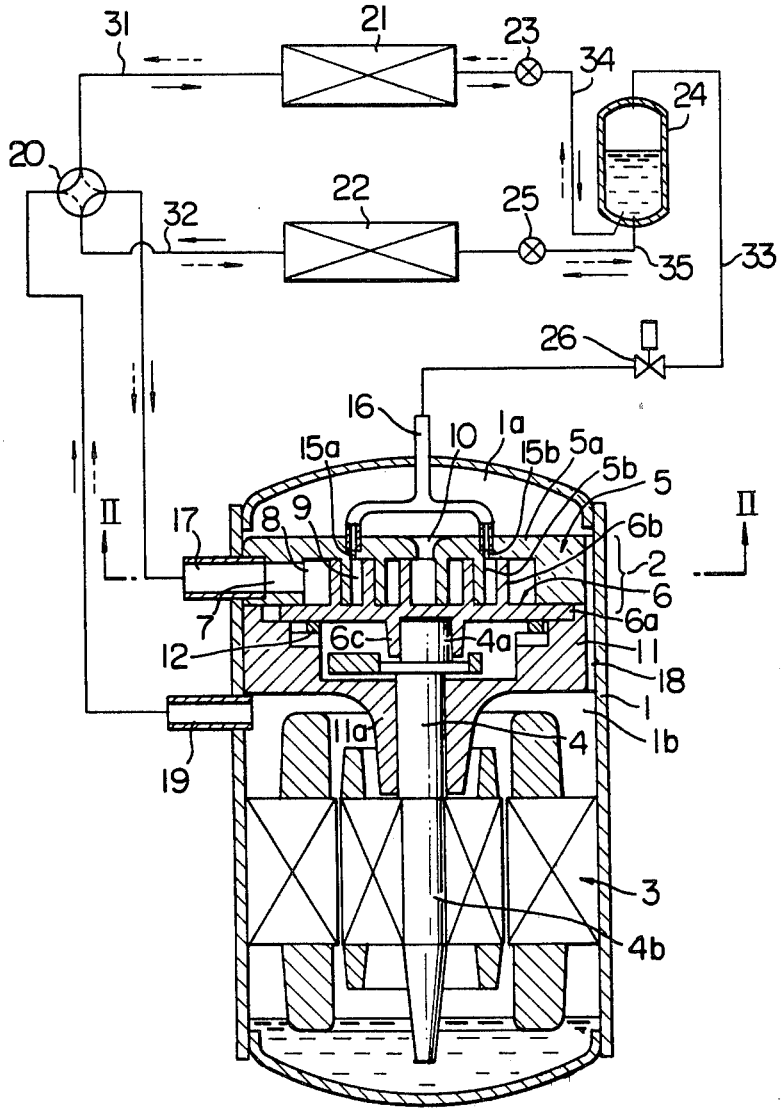
FIG. 1 is a partially schematic cross-sectional view of a heat pump type refrigeration system provided with a gas injection mechanism in accordance with a first embodiment of the present invention.

Referring now to the drawings wherein like reference numerals are used throughout the various views to designate like parts and, more particularly, to FIG. 1, according to this figure, a scroll type compressor includes a closed housing 1 accommodating a compressor section 2 and a motor section 3, with the compressor section 2 including a fixed scroll member generally designated by the reference numeral 5 and an orbiting scroll member generally designated by the reference numeral 6 which cooperating with each other in defining compression chambers 9. More specifically, the fixed scroll member 5 has a disc-shaped end plate 5*a* and a wrap 5*b* formed along an involute curve or a curve approximating an involute curve so as to protrude upright from one side of the end plate 5*a*. A discharge port 10 and a suction port 7 are respectively formed in the central portion and a peripheral portion of the fixed scroll member 5. On the other hand, an orbiting scroll member 6 has a disc-shaped end plate 6*a*, and a wrap 6*b* having the same shape as the wrap of the fixed scroll member and standing upright from the end plate 6*a*, and a boss 6*c* formed on the opposite side of the end plate 6*a* to the wrap 6*b*. A frame 11 has a central bearing 11*a* which rotatably carries a crank shaft 4, with a crank pin 4*a*, on the end of the crank shaft 4, being rotatably received by the boss 6*c*.

The fixed scroll member 5 is fixed to the frame 11 by means of a plurality of bolts, while the orbiting scroll member 6 is carried by the frame 11 through an Oldham's mechanism 12 which is constituted by an Oldham's ring and an Oldham's key, so that the orbiting scroll member 6 is adapted to make an orbiting motion with respect to the fixed scroll member 5 without rotating around its own axis. The motor section 3 includes an electric motor having a rotor shaft 4*b* directly connected at the lower end of the crank shaft 4.

Gas injection ports 15*a* and 15*b* are formed in the end plate 5*a* of the fixed scroll member 5. An injection pipe 16 is connected to the gas injection ports 15*a*, 15*b* through the wall of the closed housing 1.

A suction pipe 17 is extended through the wall of the closed housing 1 and is connected to the suction port 7 of the fixed scroll member 5. A discharge chamber 1*a* to which the discharge port 10 opens is communicated through a discharge pipe 19 which extends through the wall of the closed housing 1.

In operation, as the crank shaft 4 is driven by the motor 3, the crank pin 4*a* makes an eccentric rotation which, in turn, causes an orbiting movement of the orbiting scroll member 6 through the boss 6*c*. As a result of this orbiting motion, the compression chamber is gradually moved towards the center to reduce its volume. Meanwhile, the gas is sucked into the suction chamber 8 through the suction pipe 17 and then through the suction port 7, and is compressed in the compression chamber. The compressed gas is discharged through the discharge port 10 into the discharge chamber 1*a* and further to the lower chamber 1*b* through the passage 18. The gas is finally discharged to the outside of the compressor through the discharge pipe 19.

Figure 2:
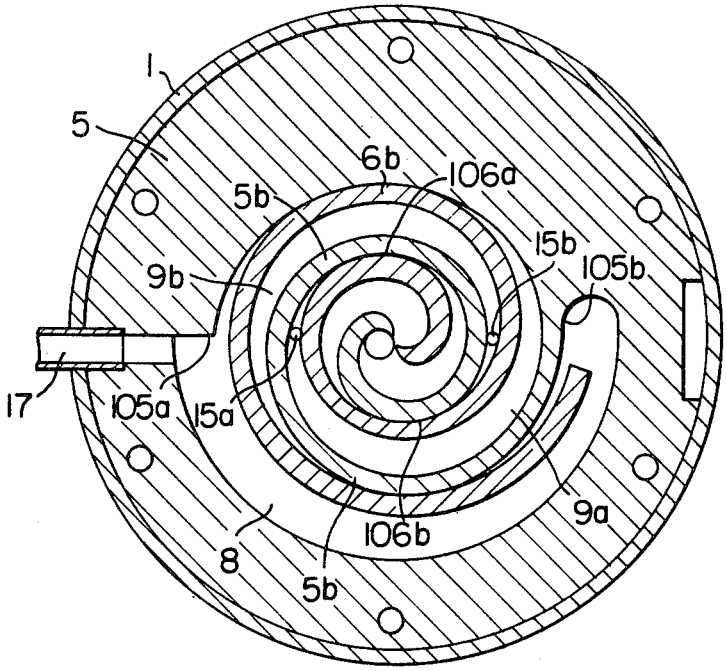
FIG. 2 is a cross-sectional view of the scroll type compressor taken along the line II—II of FIG. 1.
Figure 3:
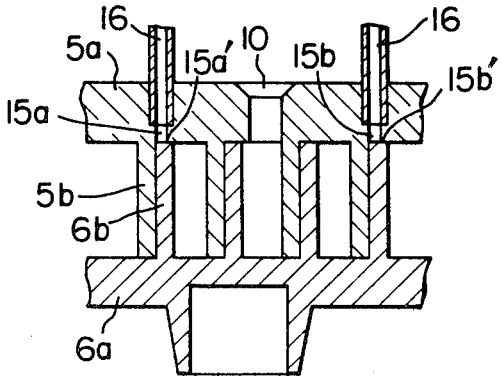
FIG. 3 is a partly-sectioned enlarged view of a scroll member provided with a gas injection port shown in FIG. 1.

As shown in FIG. 2, the gas injection port 15*a* is formed at a position which is spaced inwardly from the outer peripheral end 105*a* of the inner surface of the spiral wrap 5*b* of the fixed scroll member 5 by a distance equal to or greater than one pitch of the wrap, in the portion of the end plate adjacent to the wall of the wrap. The gas injection port 15*a* has a circular form and the distance between this port and the outer periphral end 105*a* of inner surface of the spiral wrap 5*b* is equal to one pitch of the wrap. Similarly, the other gas injection port 15*b* is formed in a circular shape in a portion of the end plate adjacent to the wrap wall, at a position which is spaced inwardly from the outer peripheral end 105*b* of outer surface of the spiral wrap 5*b* of the fixed scroll member 5 by a distance equal to or greater than one pitch of spiral wrap. In the illustrated embodiment, the distance is equal to one pitch of the spiral wrap. As shown in FIG. 3, the diameters of the gas injection ports 15*a*, 15*b* are so selected that the distance between the wall of the wrap 5*b* and the edges 15*a*', 15*b*' of the ports, in the radial direction of the end plate, is less than the thickness of the wrap 6*b*.

As shown in FIG. 2, the injection port 15*a* is adapted to be brought into communication with the compression chamber 9*a* immediately after the contact point 106*a* between the wraps 5*b* and 6*b* of the fixed and orbiting scroll members has passed this port, i.e. immediately after the suction is over, and is maintained in communication over almost one crank rotation until the next contact point passes this port. Similarly, the other gas injection port 15*b* is held in communication with the compression chamber 9*b* over substantially one crank rotation from the time at which the contact point 106*b* between walls of wraps passes this port until the moment at which the next contact point passes this port. The contacts points 106*a* and 106*b* pass respective gas injection ports 15*a* and 15*b* immediately after the suction chambers are closed as a result of orbiting motion of the orbiting scroll member to commence the compression.

As stated before, the gas injection ports 15*a* and 15*b* are so sized that the port edges 15*a*', 15*b*' is less than the thickness of the wrap. Therefore, two compression chambers defined at both sides of the wall of the spiral wrap 6*b* of the orbiting scroll member are never communicated with each other through the gas injection port.

The suction pipe 17 and the discharge pipe 19 are connected at their ends to two passages of a four-way valve 20 of the refrigerant circuit. One of the remaining two passages of the four-way valve 20 is connected to the indoor heat exchanger 21 through a pipe 31, while the other is connected to the outdoor heat exchanger 22 through a pipe 32. These heat exchangers 21 and 22 are connected to each other through pipes 34 and 35 which incldue a first pressure reducer 23, gas-liquid separator 24 and a second pressure reducer 25, to thereby form a heat pump type main refrigerant circuit. The pressure reducer may, for example, employ expansion valves.

A pipe 33 is connected to an upper portion of the gas-liquid separator 24. The pipe 33 is provided at its intermediate portion with a solenoid stop valve 26, with the other end of this pipe 33 being connected to the injection pipe 16. The full-line arrow and broken line arrow in the main refrigerant circuit respectively represent the directions of flow of refrigerant during heating and during cooling.

By turning the four-way valve 20 to the position shown by full line, the refrigerant circuit is formed to include, as shown by full line, the discharge pipe 19 of the scroll type compressor, four-way valve 20, indoor heat exchanger 21, first pressure reducer 25, outdoor heat exchanger 22, four-way valve 20 and the suction pipe 17 of the scroll type compressor. Therefore, the system operates in the heating mode in which the indoor heat exchanger 21 and the outdoor heat exchanger 22 respectively function as a condenser and an evaporator.

As the four-way valve is turned to the position in broken line, the refrigerant circuit is formed as shown by broken line to include the discharge pipe 19 of the scroll type compressor, four-way valve 20, outdoor heat exchanger 22, second pressure reducer 25, gas-liquid separator 24, first pressure reducer 23, indoor heat exchanger 21, four-way valve 20 and the suction pipe 17 of the scroll type compressor. Therefore, the system operates in the cooling mode in which the outdoor heat exchanger 22 and the indoor heat exchanger 21 respectively serve as a condenser and an evaporator.

In the heating mode operation, the compressed gas coming out of the discharge pipe 19 is introduced into the indoor heat exchanger (condenser) 21 through the four-way valve 20 and discharges the heat in the indoor heat exchanger 21 to heat the room air. The refrigerant itself is cooled and liquefied as a result of the discharge of the heat. The liquefied refrigerant is then introduced into the first pressure reducer 23 where the pressure is reduced and a part of the refrigerant is evaporated. The refrigerant is then introduced through the pipe 34 into the gas-liquid separator 24 where the gaseous refrigerant and refrigerant in the liquid state are separated from each other. The liquid refrigerant passes through the second pressure reducer 25 through the pipe 35 so that the pressure of this liquid refrigerant is reduced to form a two-phase flow consisting of gaseous phase and liquid phase which is then introduced into the outdoor heat exchanger 22 which serves as an evaporator, where the refrigerant absorbs the heat and evaporates to become gaseous refrigerant which, in turn, is sucked by the scroll type compressor through the suction pipe 17 through the four-way valve 20.

The gaseous refrigerant separated from the gas-liquid separator 24 is accumulated in the upper part of the gas-liquid separator 24. Since the pressure in the gas-liquid separator is higher than the suction pressure, the refrigerant gas is injected from the gas injection ports 15*a*, 15*b* formed in the scroll member 5 into the compression chambers 9*a*, 9 *b* which have just commenced the compression, through the pipe 33, solenoid stop valve 26 and the injection pipe 16, provided that the solenoid stop valve 26 is opened. By the time the pressure in the compression chamber 9*a*, 9*b* is increased to exceed the pressure in the gas-liquid separator 24 as a result of orbiting motion of the orbitting scroll member 6, both of the gas injection ports 15*a* and 15*b* are isolated from the compression chambers 9*a*, 9*b* by the orbiting displacement of the spiral wrap 6*b* of the orbiting scroll member 6. Consequently, the injection of the gas is finished with the compression chambers, 9*a*, 9*b* and the injection ports 15*a*, 15*b* are brought into communcation with next compression chambers.

As described hereinabove, in the scroll type compressor, the compression chambers are communicated with the gas injection ports 15*a*, 15*b* only over a period in which the internal pressure in the compression chambers is low, so that it is not necessary to provide a specific mechanism for preventing a reverse flow of the injected gas.

As a result of the gas injection, the flow rate of the compressed refrigerant gas is increased so that the flow rate of the refrigerant through the indoor heat exchanger (condenser) 21 and, hence, the rate of discharge of the heat are increased to enhance the heating capacity.

The gas injection can be made not only in the described heating mode operation but also in the cooling mode operation which is performed when the four-way valve 20 is switched to reverse the refrigerant circuit, merely by opening the solenoid stop valve 26. In this case, the difference in enthalpy of the refrigerant between the inlet and outlet of the indoor heat exchanger (evaporator) 21 is such that the rate of heat absorption is increased to enhance the cooling capacity.

As stated before, it is possible to operate the system in such a manner that the solenoid stop valve 26 is opened to effect the gas injection in the heating mode operation, whereas, in the cooling mode operation, the solenoid stop valve 26 is closed to suspend the gas injection. By so doing, it is possible to increase the heating capacity to as compared with the cooling capacity thereby permit the heat pump type air conditioner to operate with capacities well respectively meeting the cooling and heating loads or demands.

Figure 4:
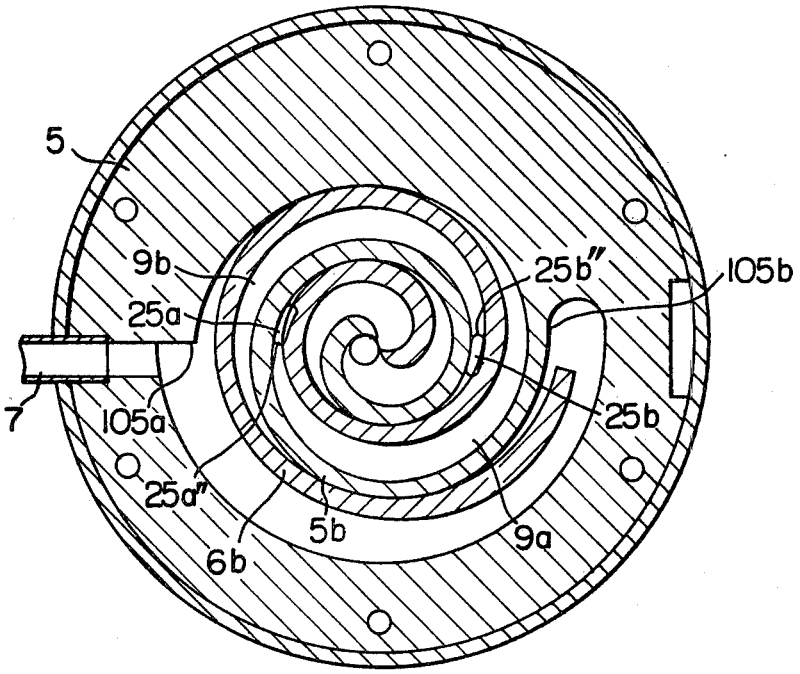
FIG. 4 is a cross-sectional view of a scroll member taken along the line II—II in FIG. 2, showing another form of the injection port.

In FIG. 4, unlike the gas injection port having a circular form shown in FIG. 2, the gas injection port has an elongated form. More particularly, as shown in FIG. 4, the injection ports 25*a* and 25*b* are formed to have a curvilinar elongated shape extending along the side wall of the wrap 5*b* of the fixed scroll member 5.

In FIG. 4 the opening length between the wall of the wrap and the other port edge, in the radial direction of the end plate, is limited so as to be less than the thickness of the wrap and the longitudinal open edges 25*a*″ and 15*b*″ of the injection ports 25*a*, 25*b* are spaced inwardly from the outer ends 105*a*, 105*b* of the inner and outer surfaces of the spiral wrap of the stationary scroll member by a distance greater than one pitch of the wrap.

Figure 5:
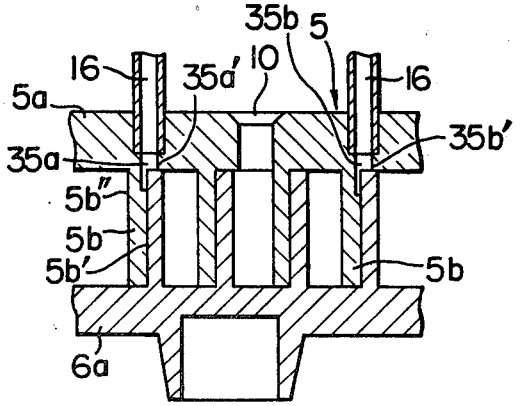
FIG. 5 is a partial vertical sectional view of the scroll member of another form of the injection port.

In FIG. 5, injection ports 35*a*, 35*b* extend through the thickness of the end plate 5*a* of the fixed scroll member 5 cut into the spiral wrap 5*b* of the fixed scroll member. More particularly, the gas injection ports 35*a*, 35*b* have a diameter greater than that of the gas injection ports shown in FIG. 3. Additionally, the radial distance between the port edges 35*a*′, 35*b*′ and the wall 5*b*′ of the wrap is less than the thickness of the wrap. The maximum diameter of the ports 35*a*, 35*b* is selected so as to be less than double the thickness of the wrap, so that the portion of the port cutting into the wrap 5*b* does not open to the surface 5*b*″ of the wrap 5*b* opposite to the surface 5*b*′. The injection ports which cut into the spiral wrap can have an elongated form as shown in FIG. 4, as well as a circular form. When the elongated form is chosen, the distance between the wrap wall and the radial port edge is less than the thickness of the wrap and the length of the elongated port, in the radial direction of the end plate, is less than double the wrap thickness.

Figure 6:
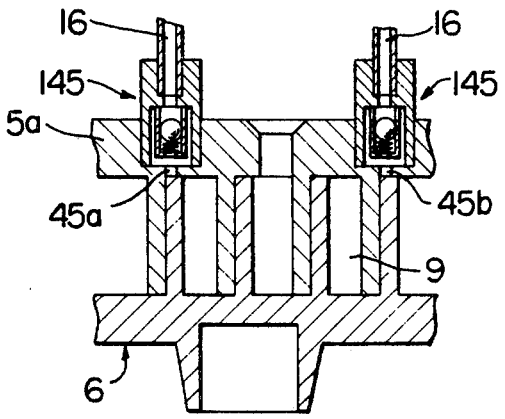
FIG. 6 is a partial vertical sectional view of a scroll member having an injection port provided with a reverse flow prevention mechanism.

Although the embodiments described hereinbefore has no mechanism for preventing reversing flow of the injected gas, it is possible to provide such a mechanism in the injection port, as will be understood from the following description of a further embodiment shown in FIG. 6.

As stated before, in the scroll type compressor in accordance with the invention, it is not necessary to provide the gas injection passage with a specific mechanism for preventing a reverse flow of the refrigerant. It is, however, conceivable that the gas is moved between the compression chamber and the injection pipe when the injection of gas is stopped, to cause a leakage of the gas which, in turn, consumes an additional compression power. To avoid this problem, it is possible to provide a mechanism for preventing reversing flow of the gas in the vicinity of the gas injection port.

In the embodiment shown in FIG. 6, a reverse flow prevention device generally designated by the reference numeral 145 is provided on the end plate 5*a* of the fixed scroll member 5 and is connected between the injection pipe 16 and the injection ports 45*a*, 45*b* which extend through the thickness of the end plate 5*a*.

Figure 7:
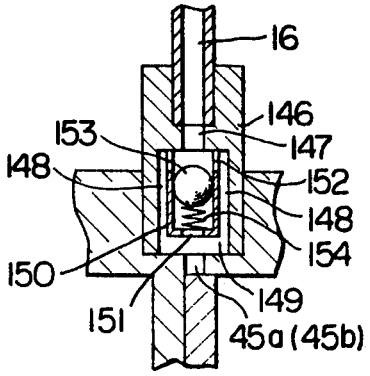
FIG. 7 is an enlarged sectional view of a reverse flow prevention mechanism.

As shown in FIG. 7, the reversing flow prevention device 145 has a bottom-equipped cylindrical housing 146 having an open end adjacent to the port 45*a* and is provided at its other end with a port 147 to which an injection pipe 16 is connected. Gaps 148 and 149 are formed in the housing 146 in which disposed is a bottom-equipped cylindrical valve case 150. The valve case 150 is mounted such that its open end faces the port 147, while a hole 151 is formed in the bottom wall of the valve case 150. A plurality of notches 152 are formed in the cylindrical wall of the open end. The space inside the valve case 150 is communicated with the gaps 148 and 149 in the housing 146. A ball valve 153 and a spring 154 are disposed in the valve case 150. The ball valve 153 is urged by the spring 154 in such a direction as to block or close the port 147.

In the reverse flow prevention mechanism, the ball valve 153 is moved up and down to open and close the valve port 147, by the pressure differential between the upper gas layer in the gas-liquid separator to which the gas injection pipe 16 is connected and the pressure chamber with which the injection ports 45*a*, 45*b* communicate. More specifically, if the pressure in the injection pipe 16 is higher than the pressure in the compression chamber, the ball valve 153 is pressed down overcoming the force of the spring 154, so that the injection pipe 16 is communicated with the injection ports 45*a*, 45*b* through the notch 152 and the gaps 148, 149, so that the refrigerant gas is injected from the upper space in the gas-liquid separator into the compression chambers. Then, as the pressure in the compression chambers is increased beyond the pressure in the injection pipe 16 as a result of the orbiting movement of the orbiting scroll member, the ball valve 153 is pushed up by the force which is the sum of the force produced by the pressure differential and the force exerted by the spring 154 to close the valve port 147 to thereby stop the gas injection and to prevent the compressed gas in the compression chambers from flowing back into the injection pipe 16.

Although the invention has been described through specific terms. It is to be noted that the described embodiment is not excusive and various changes and modifications may be imparted thereto without departing from the scope of the invention which is limited only by the appended claims.

What is claimed is:

1. A refrigeration system comprising:

a scroll type compressor including a fixed scroll member having an end plate and a spiral warp protruding upright therefrom, an orbiting scroll member having an end plate and a spiral wrap protruding upright therefrom, a discharge port formed in a central portion of said end plate of said fixed scroll member, a suction port formed in a peripheral portion of said end plate of said fixed scroll member, at least one gas injection port formed through the thickness of said end plate of said fixed scroll member in a portion of said end plate near said spiral wrap, at a position spaced from the wall of said spiral wrap by a radial distance smaller than a thickness of said spiral wrap, a discharge pipe connected to said discharge port, a suction pipe connected to said suction port, and means for causing an orbiting movement of said orbiting scroll member with respect to said fixed scroll member without permitting the same to rotate around its own axis;

a refrigerant circuit means connected between said suction pipe and said discharge pipe of said scroll type compressor and including a four-way valve, indoor heat exchanger, first pressure reducer, gas-liquid separator, second pressure reducer, and an outdoor heat exchanger; and a gas injection passage means connected between a gas outlet formed in an upper part of said gas-liquid separator and said gas injection port, so as to permit the refrigerant gas in the upper part of said gas-liquid separator to be additionally supplied into the compression chambers under compression in said scroll type compressor.

2. A refrigeration system according to claim 1, wherein one gas injection port is provided at each position where equal pressure is established in symmetrical compression chambers under compression.

3. A refrigeration system according to claim 1, wherein said gas injection port is formed along an inner or outer surface of the spiral wrap of said fixed scroll member at a position spaced inwardly from an outer end of said inner or outer surface of said spiral wrap of said fixed scroll member by a distance equal to or greater than one pitch of said spiral wrap.

4. A refrigeration system according to claim 1, wherein said gas injection port has one of a circular form of a diameter less than a thickness of said spiral wrap or an elongated form having a width less than the thickness of said spiral wrap.

5. A refrigeration system according to claim 1, wherein said gas injection port is formed through a bottom of a valley between adjacent walls of said spiral wrap in such a manner so as to partly cut into said spiral wrap, and has one of a circular or elongated circular form of a diameter less than double a thickness of said wrap.

6. A refrigeration system according to claim 1, further comprising a reverse flow prevention mechanism disposed in said gas injection passage means.

7. A refrigeration system according to claim 1, further comprising a solenoid stop valve disposed in said gas injection passage means.

8. A refrigeration system according to claim 7, wherein said solenoid stop valve is opened during an operation in heating mode of said refrigeration system and closed during operation in a cooling mode of the same.

9. A refrigeration system comprising:

a scroll type compressor means including a fixed scroll member having a spiral wrap, an orbiting scroll member having a spiral wrap, at least one gas injection port extending through an end plate of the fixed scroll member near said spiral wrap, a discharge pipe means, and a suction pipe means:

a refrigerant circuit means connected between said suction pipe means and said discharge pipe means of said scroll type compressor, the refrigerant circuit means including a four-way valve means, an indoor heat exchanger means, a first pressure reducer means, a gas-liquid separator means, a second pressure reducer means, and an outdoor heat exchanger means; and, a gas injection passage means connected between a gas outlet formed in an upper part of said gas-liquid separator means and said gas injection port for supplying a refrigerant gas in the upper part of said gas-liquid separator into compression chambers under compression in the scroll-type compressor means.

10. A refrigeration system according to claim 9, wherein said gas injection port is formed along one of an inner or outer surface of the spiral wrap of said fixed scroll member at a position spaced inwardly from an outer end of said inner or outer surface of said spiral wrap of said fixed scroll member by a distance which is equal to or greater than one pitch of said spiral wrap.

11. A refrigeration system according to claim 1, wherein said gas injection port has one of a circular form of a diameter less than a thickness of said spiral wrap or an elongated form having a width less than the thickness of said spiral wrap.

12. A refrigeration system according to claim 1, wherein said gas injection port is formed between adjacent walls of said spiral wrap in such a manner so as to partly cut into said spiral wrap and has one of a circular or elongated circular form of a diameter less that double a thickness of said wrap.

13. A refrigeration system according to claim 9, further comprising a reverse flow prevention mechanism disposed in said gas injection passage means.

* * * * *